US008371091B2

(12) United States Patent
Graf

(10) Patent No.: US 8,371,091 B2
(45) Date of Patent: Feb. 12, 2013

(54) BUILDING SYSTEM AND METHOD WITH PREFABRICATED STRUCTURES JOINED BETWEEN THEM, REUSABLE AND TRANSPORTABLE

(76) Inventor: Rodrigo Graf, Denver, CO (US)

( * ) Notice: Subject to any disclaimer, the term of this patent is extended or adjusted under 35 U.S.C. 154(b) by 475 days.

(21) Appl. No.: 12/427,887

(22) Filed: Apr. 22, 2009

(65) Prior Publication Data

US 2009/0260302 A1 Oct. 22, 2009

Related U.S. Application Data

(60) Provisional application No. 61/046,961, filed on Apr. 22, 2008.

(51) Int. Cl.
*E04B 1/343* (2006.01)

(52) U.S. Cl. ..... 52/745.02

(58) Field of Classification Search ..... 52/79.7, 52/79.8, 745.02, 745.2
See application file for complete search history.

(56) References Cited

U.S. PATENT DOCUMENTS

| | | | | | |
|---|---|---|---|---|---|
| 1,156,693 | A | * | 10/1915 | Koger | 296/26.01 |
| 3,707,811 | A | * | 1/1973 | Hampson | 52/23 |
| 3,182,424 | A | | 1/1974 | Vogel | |
| 3,982,732 | A | * | 9/1976 | Pender | 414/10 |
| 4,200,419 | A | * | 4/1980 | Rogers, Jr. | 414/12 |
| 4,854,094 | A | * | 8/1989 | Clark | 52/79.1 |
| 5,560,444 | A | | 10/1996 | Tiedge | |
| 5,639,139 | A | | 6/1997 | Rush | |
| 5,847,537 | A | | 12/1998 | Parmley, Sr. | |
| 6,511,092 | B1 | | 1/2003 | Chepa | |
| 6,746,040 | B2 | | 6/2004 | Bordeleau et al. | |
| 6,860,536 | B1 | | 3/2005 | Schimunek | |
| 6,883,849 | B2 | | 4/2005 | Hebert | |
| 6,925,761 | B1 | * | 8/2005 | De La Marche | 52/79.7 |
| 6,983,567 | B2 | * | 1/2006 | Ciotti | 52/79.5 |
| 7,052,033 | B2 | | 5/2006 | McDonell | |
| 7,765,745 | B2 | * | 8/2010 | Kmet et al. | 52/79.9 |
| 2009/0145079 | A1 | * | 6/2009 | Garcia | 52/745.19 |

FOREIGN PATENT DOCUMENTS

| | | |
|---|---|---|
| DE | 1953109 | 4/1971 |
| FR | 2441703 | 6/1980 |
| WO | 9311329 | 6/1993 |

* cited by examiner

*Primary Examiner* — Christine T Cajilig
(74) *Attorney, Agent, or Firm* — Roylance, Abrams, Berdo & Goodman, L.L.P.

(57) ABSTRACT

A building system and method by means of at least two prefabricated structures comprising a first prefabricated structure containing at least two lateral walls, a front wall and a back wall; a second prefabricated structure containing at least two lateral walls, a front wall and a back wall; a first transportation axis in which said first prefabricated structure is mounted, capable of towing said first prefabricated structure to a building site and said first transportation axis is parked in the construction site; a second transportation axis in which said second prefabricated structure is mounted, capable of towing said second prefabricated structure to said building site and said second transportation axis is parked in the construction site; at least one of said lateral, back or from wall of each one of said first and second prefabricated structure is dismounted, dismantled or rolled up; wherein said first and second prefabricated structures are joined in such a manner that said prefabricated structures are in communication by said dismounted, dismantled or rolled up side.

19 Claims, 12 Drawing Sheets

BUILDING SYSTEM AND METHOD WITH PREFABRICATED STRUCTURES JOINED BETWEEN THEM, REUSABLE AND TRANSPORTABLE

CROSS-RELATED APPLICATIONS

This application claims benefit from U.S. provisional application No. 61/046,961 filed on Apr. 22, 2008.

FIELD OF THE INVENTION

The present invention is related with prefabricated structures, such as semi-trailer, a shipping container, or any other similar container, that are towed or transported to particular locations; a system for building with said prefabricated structures and a method for creating buildings with said prefabricated structures. More particularly, this invention refers to at least one, and more preferably to two semi-trailers or containers, shipping or other, that are transported over a transportation axis, which when parked proximal between themselves, create a superior surface in regards to itself or other semi-trailers or similar containers, and more particularly to a system and method for joining and dismounting said prefabricated structures in a lateral, front, back, upper and lower manner so as to create a single building, wherein the prefabricated structures may be removed, dismounted and easily conveyed.

PRIOR ART DESCRIPTION

Expandable systems for prefabricated structures, such as semi-trailers or shipping container, are known in the prior art. It is common that a semi-trailer may expand its space to occupy a greater space, usually from a retracted position to an expanded position. The telescopic trailers are desirable in the art to gain space where allowed, and contract the trailer space in narrow places.

In this type of telescopic semi-trailers, it is usual that a stop that has a transverse plate, be mounted in a telescopic rod of a trailer. A blocking assembly is mounted to the trailer rod, which carries a fixed portion of the trailer. The block assembly tilts a piston towards the expansion fixed rod so that the piston blocks a transverse plate, thus preventing relative movement of the fixed and telescopic portions in a direction. A pair of stops may be used to fix the trailer in an expanded or retracted position. Such is the case of U.S. Pat. No. 5,560,444 wherein an expandable and retractable trailer is disclosed.

Telescopic trailers are also disclosed in U.S. Pat. No. 5,639,139 wherein a telescopic trailer is adapted to be towed by a land vehicle. The trailer includes an outer body supported by wheels and has an opening therein for slidably receiving a telescoping section. A drive assembly is secured to the telescoping section for frictionally engaging a drive wheel with a surface beneath the trailer and rotating the drive wheel to selectively extend and retract the telescoping section. An optional chain drive assembly is provided to the trailer for assisting the drive assembly in selectively moving the telescoping section relative to the outer body.

Other patents disclosing telescopic trailers which are expandable and retractable, are U.S. Pat. Nos. 6,746,040, 6,860,536, 6,883,849 and 7,052,033.

U.S. Pat. No. 6,511,092 discloses an expandable utility trailer system which includes multiple trailer bed sections that are attached together to form a utility trailer of the desired size and disconnectable for storage in a small area. The expandable utility trailer system including a main trailer bed assembly, a front bed assembly, a back bed assembly; a number of side barrier sections, a brake light/turn signal circuit including a turn signal reverse operation switch, and a trailer tongue assembly.

One of the differences between the present invention and U.S. Pat. No. 6,511,092 or any other known document is the connection capacity of the units or containers to different trailers in a lateral manner and not limited only to a front and back connection as per said patent. Additionally, this patent does not disclose that the semi-trailers or containers may be towed to dismount the building.

In U.S. Pat. No. 4,854,094 a method of converting one or more shipping containers to a livable building in a construction site and the product of the same, wherein the disclosed method comprises mounting at least one shipping container on a base, and when two or more containers are used, the containers may be joined in a side by side relationship and/or may be mounted one over the other. When the containers are mounted side by side, the portions of the lateral walls are removed. An elevated floor is installed over the lower walls of the containers and a lower wall is mounted. Different than the present invention, U.S. Pat. No. 4,854,094 cannot be easily towed from the building site, since the transportation axis is totally removed so that the container may be implanted or placed in the constructed base, that is, the container is independent of the axis or from the trailer.

French patent No. 2 441 703 discloses a modular construction, wherein the elements are two containers, characterized in that the vertical angle elements of the contains and/or the vertical construction elements previous to the proximity of the base elements are constituted by vertical carrier elements and in that the interior of the containers are offices. Likewise, the invention of French patent No. 2 441 703 cannot be towed from the building site, since the transportation axis has been removed so that the container may be implanted in a built base and therefore the axis or trailer is independent of the containers, semi-trailers or modules that comprise the building.

German patent No. 1 953 109 discloses a transportable house made from a container. As does the US patent and the French patent, the container of the German patent cannot be towed from the building site, and further, said German patent does not disclose the joining of two or more containers.

U.S. Pat. No. 3,182,424 discloses a shipping container and exposition location to provide a movable portable show, comprising a rectangular shipping container with four vertical columns near to and supporting the floor and roof in their respective borders, two opposed end walls connected to and extending between the pairs of adjacent said border columns and a pair of lateral doors, having a height and length substantially equal, respectively, the distance between the floor and roof and that distance between said opposed end walls, said pair of doors being mounted in a longitudinal axis of the roof, so that the doors may be elevated to form a canvas and when lowered form lateral walls of the box. Different than the present invention, U.S. Pat. No. 3,182,424 does not disclose the union of two or more containers, wherein when these containers are joined, may be dismounted and towed. Likewise, even though said patent discloses that the containers are portable, the containers, in case of containers near to the floor, have to be elevated by a crane, as stated in claim 1 of said patent, and must be placed in the bed of a truck so that they may be towed.

U.S. Pat. No. 6,983,567 discloses livable rectangular transformable structures, that include a base and that have a pivotable outer annex and inner walls that bend outwardly to form a livable structure. The structure walls are previously wired and installed with plumbing and are adapted to connect and appropriate the outer administration resources of the structure. Even though it is mentioned that they are portable, the containers have to be elevated by a crane and placed in the bed of a truck to be towed.

In U.S. Pat. No. 5,847,537, an electrical vehicle charging station system is disclosed, that has an edification that contains charging equipment and may provide other auxiliary services. Specifically FIGS. 9, 10 and 13 disclose that the station may be mounted over a smooth surfaces. However, different to the present invention, the container including the smooth surface, must be mounted to a truck as shown in FIG. 13.

Similar to other publications, publication WO 93/11329 discloses a transportable house which must be assembled in the floor. Therefore, different to this publication, the present invention provides a quick dismounting and towability from the construction site and that forms part of the transport system, towing axis or trailer.

FIG. 1 shows a prefabricated structure prior to its modification. Said prefabricated structures may be exemplified by, however not limited to, shipping containers, train containers, other types of containers or semi-trailers that are structurally strong. In general, this type of prefabricated structures have standard measures, specially the shipping containers, since they have to comply with ISO standards; specifically, this prefabricated structures may be found, among others, in measures of 20, 40, 45 and 53 feet, with determined heights and widths, as well as determined load capacities.

These structures are transported in transporting axis, and as may be seen in the above patents, and are dismounted over bases or feet, usually by means of cranes or inclinable truck bases, or over the ground as such, and then a building is constructed.

The prefabricated structures allow themselves to be stacked or laterally joined to other prefabricated structures, cine in the columns, specifically in its edges, an accessory with connected holes in its outer faces, wherein the accessory is adapted so that cables are tied, known elements such as twist locks are placed or that ropes may be passed therethrough. These accessories may be used to hook the containers one with another or the bases of the same; in the case of the present invention, these accessories are used to hook the containers one with another in a vertical manner, or that the container is hooked to the transportation axis.

Therefore, it would be desirable to include a prefabricated structure connection system, such as semi-trailer, shipping container or any other type of prefabricated structure, that may connect in its front, back, as well as its lateral, upper and lower parts, to other prefabricated structures creating a building.

Likewise, it would be desirable to have a prefabricated structure that may create a platform or embedded beds, thus creating a connection system of different prefabricated structures so as to create a greater surface.

In another embodiment, it would be desirable to have a prefabricated structure having a plurality of tongues in each one of its ends, to create a connection system among different prefabricated structures under this type of system.

Finally, it would be desirable to obtain from these systems, further to the joining of the prefabricated structures, a greater surface occupancy in comparison to a single prefabricated structure, however it would be even more desirable that said joint of all the prefabricated structures seem as a single structure.

Likewise, it would be desirable obtaining a prefabricated structure capable of joining with similar prefabricated structures, wherein said prefabricated structures may be towed, mounted, dismounted, removed and conveyed with easiness to a new site.

BRIEF DESCRIPTION OF THE INVENTION

The invention refers to the connection or coupling system between different prefabricated structures, such as semi-trailers, shipping containers or similar containers to achieve a substantially uniform platform in a determined space, which may be irregular, thus creating a building. The system and method create a substantially uniform platform area, superior in area dimension, depending on the number of lateral, front and back connections achieved between the different prefabricated structures that are found placed in the transport axis. Likewise, the system and method may create a substantially uniform platform area, superior in area dimension in a horizontal manner, depending on the upper and lower stacking achieved between the different prefabricated structures.

It has been seen in the prior art, that obtaining work, help centers, disaster relief centers, living and/or recreation platforms in inhospitable spaces, may be of great economical benefit for users and of great human need in cases, for example of natural disasters.

In an embodiment a tongue assembly or connection be it lateral, front and back is disclosed. The afore-mentioned can be obtained having a prefabricated structure, such as a semi-trailer, a shipping container or a similar container with a main bed which is fixed, wherein different beds, such as a front bed, a back bed and at least one lateral bed, are telescopic, and are embedded below the main bed. Furthermore, each of the telescopic beds, that is, the front, back and at least one lateral bed, may be mounted over a telescopic rod or driving portions that guide the telescopic beds towards the exterior in regards to the main fixed bed. The height distance between each of the beds is such, that when crossing from one bed to another, the height difference is not felt. However, the height distance between each of the beds may be such that bridges, boards or joint creating assemblies between each of the beds are needed. Additionally, in view of the height difference between each bed, a joint system between the beds may be achieved. That is, the front bed may be at a determined height, wherein said height is less than the height of the main bed, however greater than the back bed, so that the front bed may be coupled with the back bed of a different prefabricated structure. Likewise, the lateral bed may be at a similar height to the front bed, so that the lateral bed may be coupled with the main bed of a different prefabricated structure, that is, the heights of the beds may or may not be in different levels. A ground fixing assembly may be vertically retracted and expanded from each of the telescopic beds. The fixing and/or elevation assembly may include a lift, automatic or manual, to elevate and support the telescopic beds, so that each of the telescopic beds remain at the same height once extracted and placed. Optionally, a driving portion coupled to the lift, allows the telescopic bed to be extended from and retracted to the main bed. As mentioned before, in this embodiment the telescopic beds are capable of joining at least a different second prefabricated structure.

In a second embodiment, the prefabricated structure comprises a single fixed main bed only.

In a first sub-embodiment of the second embodiment, the fixed main bed has a series of telescopic tongues in their ends. The tongues are embedded beneath the fixed bed, and preferably have the same height. A front tongue has a receiving area in its front end, whilst the back tongue has a coupling area and is able to embed within the receiving area of the front tongue of a different prefabricated structure. Likewise, the a first lateral tongue has a receiving area in its front end, whilst the opposed lateral tongue has an coupling area capable of coupling and embedding within the receiving area of the first lateral tongue. In this embodiment additional lifts and fixing assemblies to those of the transportation axis are not needed, since the columns and crossbeams of the prefabricated structure will be sustaining means and the tongues do not need leveling since they may be regulating or auto-regulating.

In a second sub-embodiment of the second embodiment, the main fixed bed does not have tongues. Specifically, the joining system between main fixed beds is by means of bridges, boards or joint creating assemblies of any type of material that complies with said function.

In all of the embodiments, that is, in the first embodiment of embedded beds, the second embodiment of tongues and third embodiments of joining creating assemblies, these parts may be vertical, i.e. a vertical stacked bed, a vertical tongue or a vertical joining creating assembly may be provided, so as to join two prefabricated structures in a vertical manner.

At least one, preferably two transportation axis over which the prefabricated structures are transported, are parked or placed proximate between themselves, to create a building capable of connection between said prefabricated structures.

Therefore, all the embodiments provide removable joints, making it possible to dismount the prefabricated structures and tow said prefabricated structures easily.

Therefore, it is an object of the present invention to make a connection or coupling system between different prefabricated structures, with front, back, lateral, upper and lower connections that create a greater livable or usable area.

It is a further object of the invention to provide a connection or coupling between prefabricated structures with connections by means of fixed or semi-fixed telescopic beds, front, back, lateral, upper and lower, with coupling systems between them and with coupling systems to at least a second prefabricated structure.

Yet another object of the invention is providing a connection or coupling between different prefabricated structures by means of a plurality of tongues embedded below the prefabricated structure main bed, wherein the tongues are found in each one of the prefabricated structure ends, and wherein the tongues comprise coupling systems between them.

Another object of the present invention is providing a connection or coupling between different prefabricated structures with joint creating assemblies.

It is yet another object of the present invention, to provide from the connections or couplings mentioned before between the prefabricated structure beds or transported and towed structures, a greater inter-connected surface than that of the individual prefabricated structure.

A further object is providing a building with the joint of at least two prefabricated structures.

Finally, it a another object that the building is easily mountable and dismountable so that it may be easily re-used, transported and conveyed to different locations.

BRIEF DESCRIPTION OF THE DRAWINGS

The particular features and advantages of the invention, as well as other objects of the invention, will become apparent from the following description, taken into account with the following figures, which.

DETAILED DESCRIPTION OF THE INVENTION

The present invention refers to a building system and method with prefabricated structures joined between themselves, such as semi-trailers, shipping containers, train containers or similar containers, wherein said prefabricated structures are towed by means of a transportation axis to a building site, preferably, said structures may be pre-cut, pre-prepared, pre-isolated and pre-decorated, wherein said prefabricated structures when reaching the building site, are not dismounted from the transportation axis unless they are destined to be stacked over other prefabricated structures, rather parked proximate between themselves, creating a module edification or substantially uniform platform, to simulate a business or livable location, industrial location, relief center, recreation place or any other type.

Since the prefabricated structures are not dismounted from the transportation axis, prefabricated structures that may be easily coupled to inhospitable terrains are provided, wherein the back wheels, or in its case the front wheels, of the transportation axis and/or the front lift that in its case has the transportation axis, or even both, are capable of leveling the prefabricated structures and since the prefabricated structures are not dismounted, once the internal and external joints between two or more prefabricated structures are removed, these may be immediately towed by a truck without any need of a crane and/or greater mounting and/or greater dismounting.

The proposed building system has as advantages: (a) a quick mounting in comparison to a usual construction, (b) mounting in places wherein construction may or may not be inhospitable, such as for example, unleveled terrain, a flooded terrain, a terrain with inadequate infrastructure or construction, (c) a quick dismounting and (d) easiness to tow the mounted and dismounted structure.

From here-on-forth the term "prefabricated structure" refers to any prefabricated structure that may be transported or towed in a transportation axis, such as may be semi-trailers, shipping containers or any other type of similar structures.

From here-on-forth the term "bed" refers to the base or floor or lower part of any prefabricated structure that may be transported in a prefabricated structure and is capable of joining with similar "beds" in a lateral, front and back manner.

Likewise, the beds may be joined by stacking with the "roofs" of the prefabricated structure by means of posts, wherein "roof" refers to the ceiling or upper part of any prefabricated structure.

Figure 1:
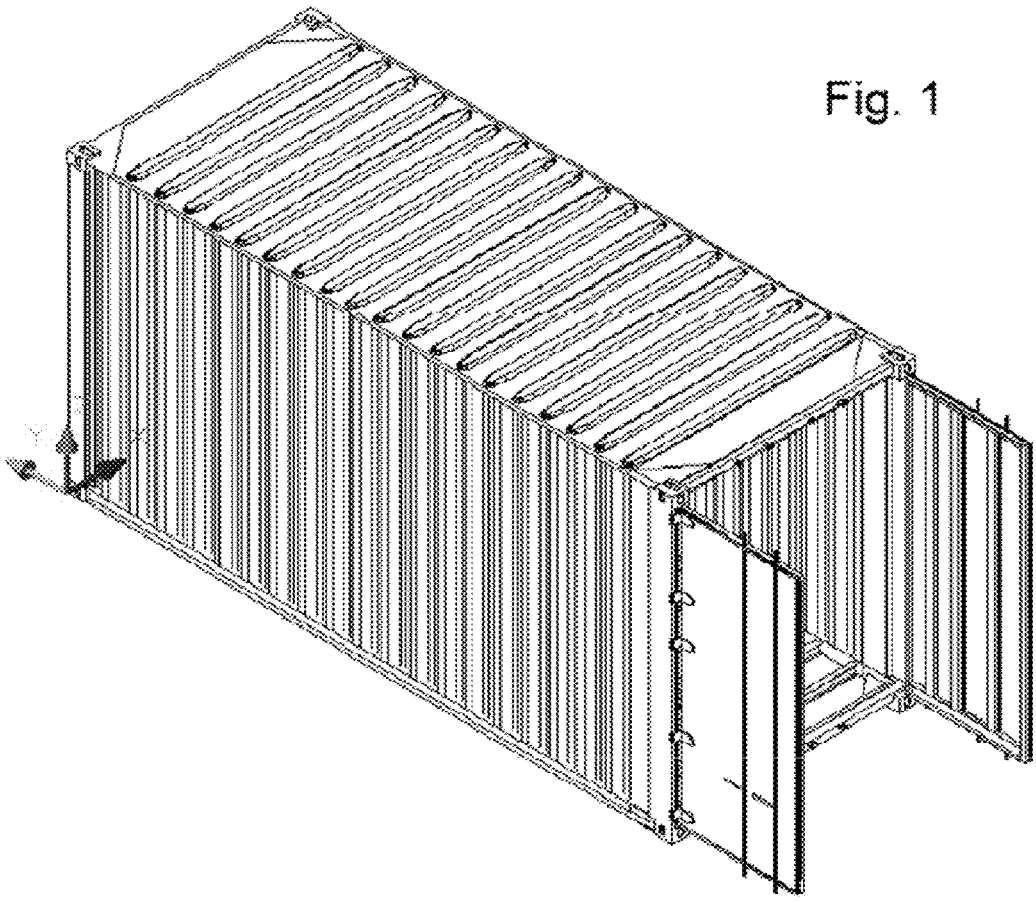
FIG. 1 is a conventional perspective view of one of the types of a prefabricated structures used in the system and method being claimed.
Figure 2:
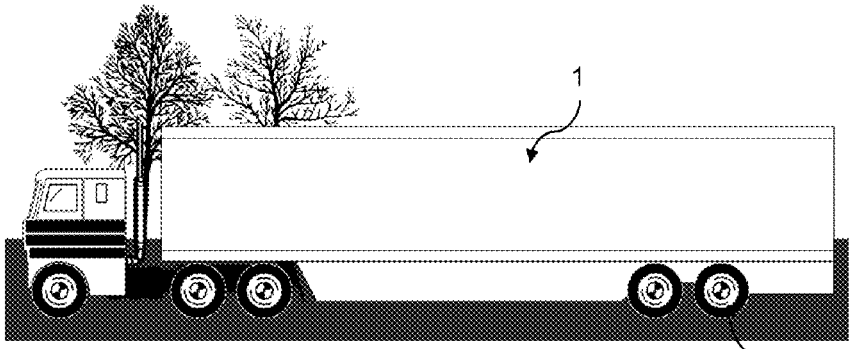
FIG. 2 is a lateral view of a first prefabricated structure being towed by a transportation axis, in this case a truck or trailer and that contains another type of container or prefabricated structure than that stated above.
Figure 3:
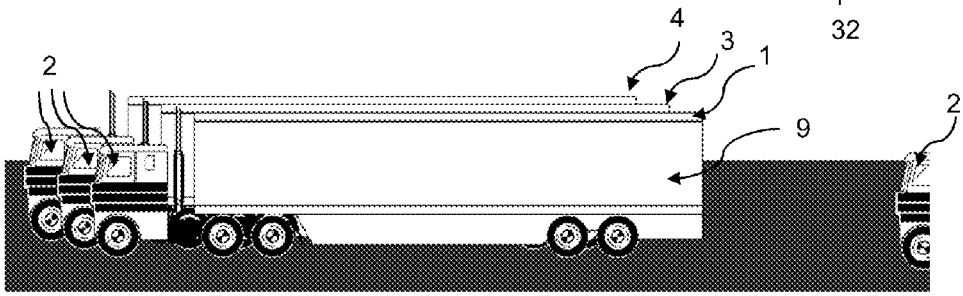
FIG. 3 is a lateral view of a prefabricated structure mounted on a transportation axis being towed and parked by the transportation axis next to another plurality of prefabricated structures mounted on their corresponding transportation axis.
Figure 4:
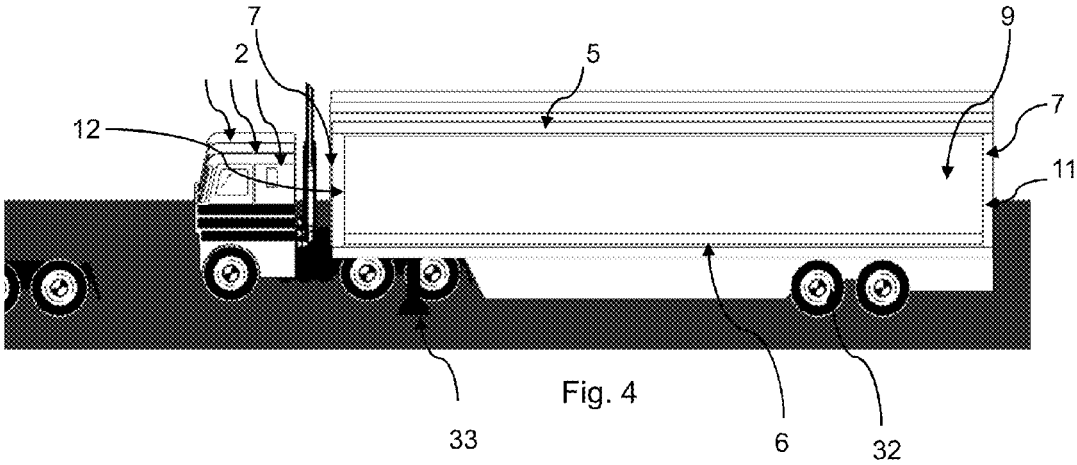
FIG. 4 is a lateral view of a prefabricated structure parked in a co-lineal axis with the plurality of prefabricated structures, wherein the prefabricated structure has been parked in its own transportation axis and the truck or trailer that towed it has left the site.

FIG. 2 is a lateral view of a prefabricated structure 1 being towed by a transportation axis 2. The prefabricated structure 1, is a semi-trailer or shipping, train or similar container 1 like any other. The present invention permits the coupling of at least two prefabricated structures, and more preferably to a plurality of prefabricated structures 1, 3, 4 in a colineal axis, wherein the coupling is by the lateral, front, back and/or upper part, such as may be seen in FIG. 3. The transport axis 2 that tows the prefabricated structures 1, 3, 4 are parked proximal to each other and leave, without dismounting, the prefabricated structures 1, 3, 4 in a determined locality in a co-lineal said prefabricated structures 1, 3 4. The prefabricated structure comprises two lateral walls 9, a main bed 6, a roof 5, a back wall 11 and front wall 12. The lateral walls 9, as well as the front 12 and back 11 wall of the prefabricated structure 1, 3, 4, are capable of being dismounted, dismantled or rolled up to the roof 5 or the main bed 6, leaving only in each one of the lateral ends posts or columns 7, so as to sustain the roof 5 of the prefabricated structures 1, 3, 4 as seen in FIG. 4.

The wheels 32 of the transport axis 2 that may be or nor be dismounted to leave in its place a support column, provide a first load point for the transport axis 2 and consequently for the prefabricated structure 1. The extended lift 33 of the prefabricated structure 1 provides a second load point for the transportation axis 2 which may also be or not be substituted by a support column. The lift 33 or column provides the leveling of the prefabricated structure 1. That is, depending on how irregular the location wherein building is being provided, the lift may be extended less or more so as to level the transportation axis and consequently the prefabricated structure 1.

Figure 5:
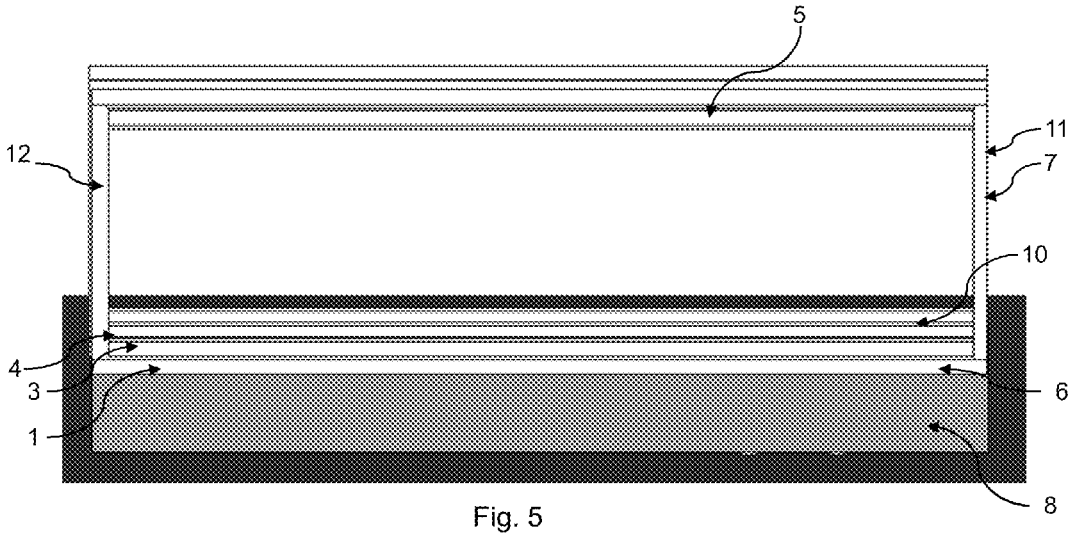
FIG. 5 is a lateral view of a plurality of prefabricated structures parked in the same co-lineal axis, wherein the prefabricated structures are open in their lateral walls and connected between themselves.

A skirt 8 in the prefabricated structure 1, 3, 4 lower part may or may not be provided to cover the transportation axis 2 and wheels 32 or column of the transportation axis 2 in the platform 10 ends, formed by the coupling of the plurality of prefabricated structures 1, 3, 4. It is preferable that the skirt 8 is embedded in the lower part of the main bed 6 without interfering with, depending of the embodiment, possible telescopic beds or tongues, which will be disclosed later on, thus the skirt 8 is un-embedded only in the prefabricated structures 1, 3, 4 that are found proximate to the platform 10 end. The prefabricated structure 1, 3, 4 skirt 8 found between the prefabricated structure 1, 3, 4 ends, are not un-embedded, as shown in FIG. 5.

While dismounting, dismantling or rolling the lateral walls 9, a platform 10 is created in the same co-lineal axis, wherein each one of the prefabricated structures 1, 3, 4 are joined by their lateral, front or back part giving a uniform mobiliary structure effect in a horizontal axis. The joining method will be explained in the following paragraphs.

Each one of the prefabricated structures 1, 3, 4 may have at least one lift 33 or load column in substitution of this last, in the lower part of the main bed 6 to elevate and sustain the main beds 6 of each one of the prefabricated structures 1, 3, 4, so as to level the prefabricated structures, so that the platform may be substantially uniform in a vertical axis. Specifically, the transportation axis 2 has at least said lift 33 in its lower part, to elevate and support the prefabricated structures 1, 3, 4 so as to level the prefabricated structures so that the platform is substantially uniform in a vertical axis.

Figure 6:
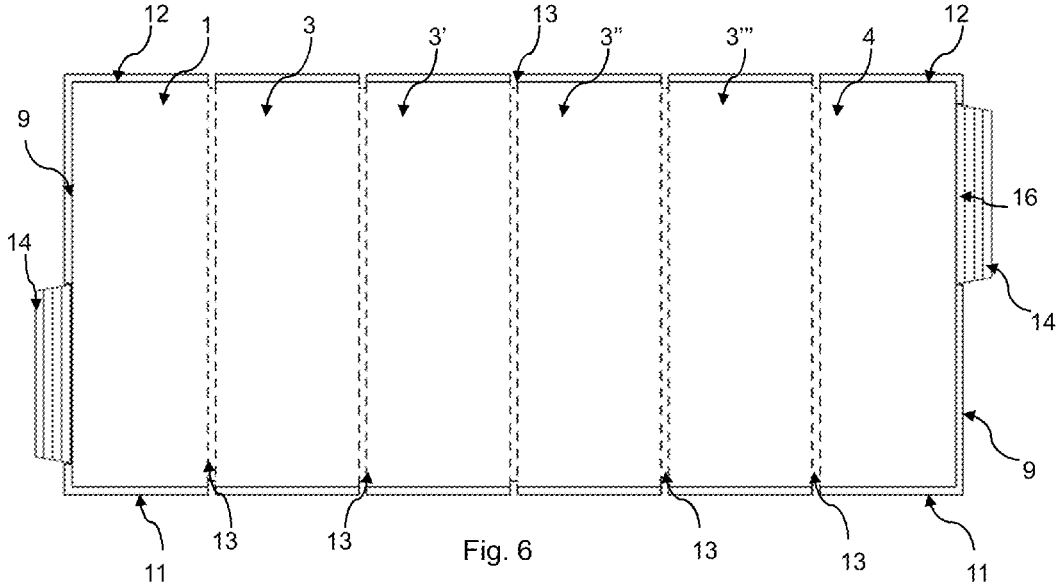
FIG. 6 is an upper view of the connection formed between the plurality of prefabricated structures, creating a platform edification, being the case of said figure, only lateral connections, which can include other connections such as front, back and/or upper.

FIG. 6 is an upper view of a plurality of prefabricated structures 1, 3', 3", 3'", 4 coupled between themselves. As disclosed above, the lateral walls 9 of the prefabricated structures 3', 3", 3'" which are not end prefabricated structures 1, 4 are dismounted, dismantled or rolled to create a substantially uniform platform 10 between the prefabricated structures. The coupling point 13 between each of the prefabricated structures will be explained below. At least one of the prefabricated structure ends 1, 4 has an aperture 16 in one of its walls. In an exemplifying manner, FIG. 6 shows that in the lateral wall 9 of the prefabricated structure said aperture 16 is formed, which may be of an inferior height than the prefabricated structure, placing a stair 14, so that the user may go inside the prefabricated structure.

Figure 7:
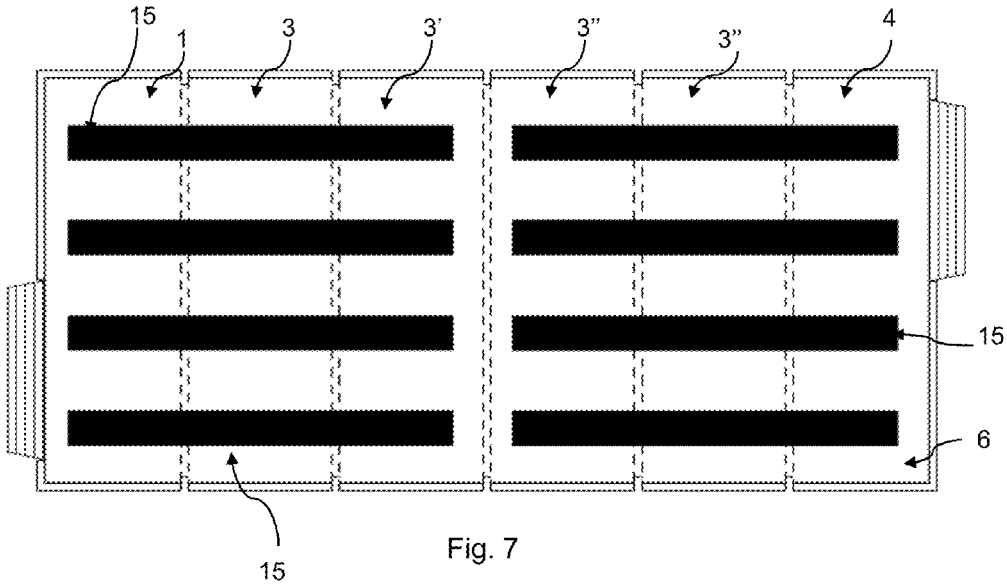
FIG. 7 is an upper view of the connection formed between the plurality of prefabricated structures, creating a platform edification with shelves or different furniture, such as beds for the case of relieve centers.

The prefabricated structures are capable of sustaining a plurality of shelves 15, work zones or furniture among other in a transversal manner to the coupling points 13, as shown in FIG. 7, or longitudinal as well. Likewise, doors, windows, and any other type of elements may be placed as well as the desired decorations in the prefabricated structures that are found in the ends, to simulate a traditional construction. Placing the shelves 15 or desired furniture in a transversal manner regarding the coupling means 13 allows distributing the shelves 15, work zones or furniture weight in an equivalent manner between each of the prefabricated structure beds 6. However, this does not mean that the shelves 15, work zones or furnitures may not be placed in a parallel or longitudinal manner in regards to the coupling points 13 throughout the bed 6.

Figure 8:
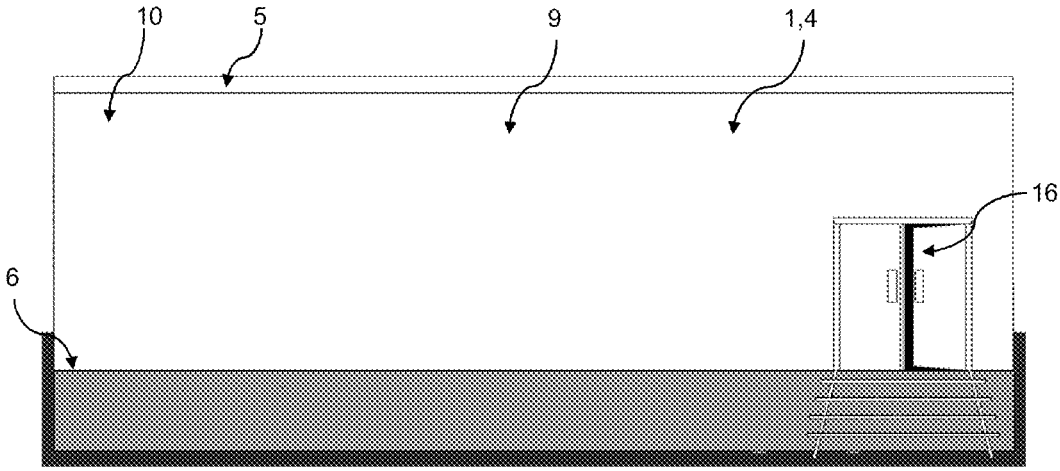
FIG. 8 is a lateral view of the platform created by the prefabricated structure connection.

FIG. 8 is a lateral view of a platform 10 end. The platform 10 comprises a substantially uniform bed 6 and roof 5 throughout said platform 10. A lateral wall 9 of the prefabricated structure ends 1, 4, covers the platform 10 ends, that is, preferably it is not dismounted, dismantled or un-rolled. The skirt 8 is placed or unrolled in each front part of each of the prefabricated structure 1, 4 ends, as well as the front or back part of each one of the prefabricated structures that are found in the platform 10 end. In the specific case of FIG. 8, joined prefabricated structures in the front and back ends are not shown, therefore all the prefabricated structures 1, 3, 3', 3", 3'", 4 have the skirt 8 unrolled or placed in the front and back end of each of said prefabricated structures. In the aperture 16 found in the lateral wall 9 of the end 1, 4 prefabricated structure, stairs 14 are coupled for easy access to the prefabricated structure.

Figure 9:
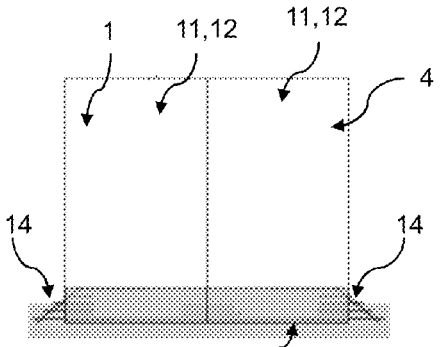
FIG. 9 is a front view of two prefabricated structures creating a platform edification.
Figure 10:
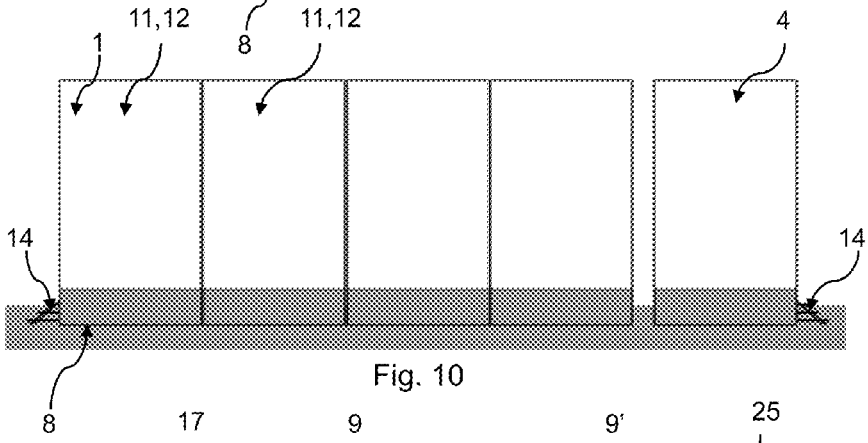
FIG. 10 is a front/back view of a plurality of prefabricated structures being joined to create a platform edification depending on the number of joints or desired structures in the joint that may be unlimited.
Figure 11:
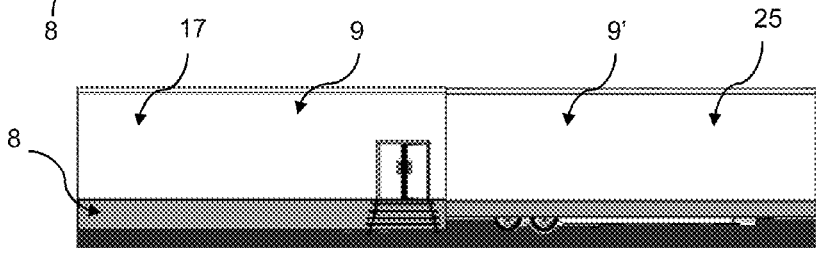
FIG. 11 is a lateral view of a plurality of prefabricated structures creating a platform edification, transversally joined by the back part of another prefabricated structure or axis that contains another prefabricated structure.
Figure 12:
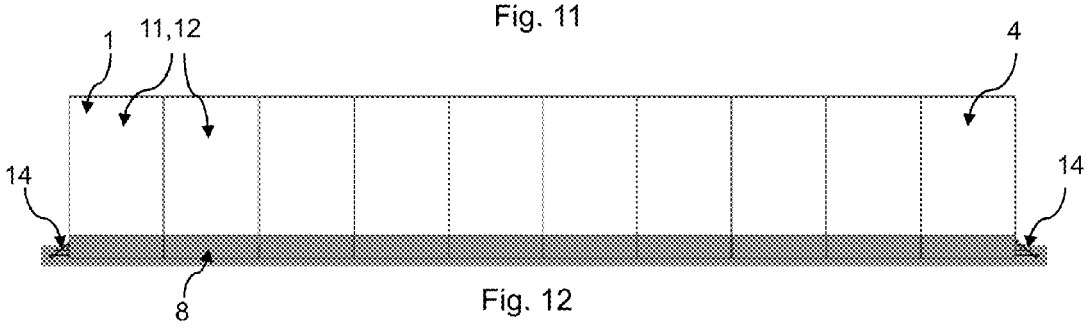
FIG. 12 is a front/back view of a plurality of prefabricated structures creating a platform edification.

A plurality of prefabricated structures are coupled with the system of the present invention, as shown in FIGS. 9, 10 and 11, which are front or back views of the prefabricated structure joining system. The figures show the stairs 14 in the lateral wall 9 of the end 1, 4 prefabricated structures in each one of the embodiments. The number of prefabricated structures to couple is not the object of the invention, since the number of prefabricated structures may become an unlimited number depending on the location and the surface.

The skirts 8 of each of the prefabricated structures and transportation axis 2 cover the transportation axis 2 and wheels 32 of the transportation axis, therefore, improving aesthetically the aspect of the prefabricated structure, giving it a traditional prefabricated construction aspect.

In FIG. 11, contrary to the other figures, a second prefabricated structure 17 is shown, coupled by its back end to the front end of a first prefabricated structure 25. The coupling in the front and back ends of the prefabricated structures 17, 25, is independent of the lateral coupling between the prefabricated structures, that is, the lateral prefabricated structure coupling, may be carried out in a joint manner with the front and/or back prefabricated structure coupling.

Figure 13:
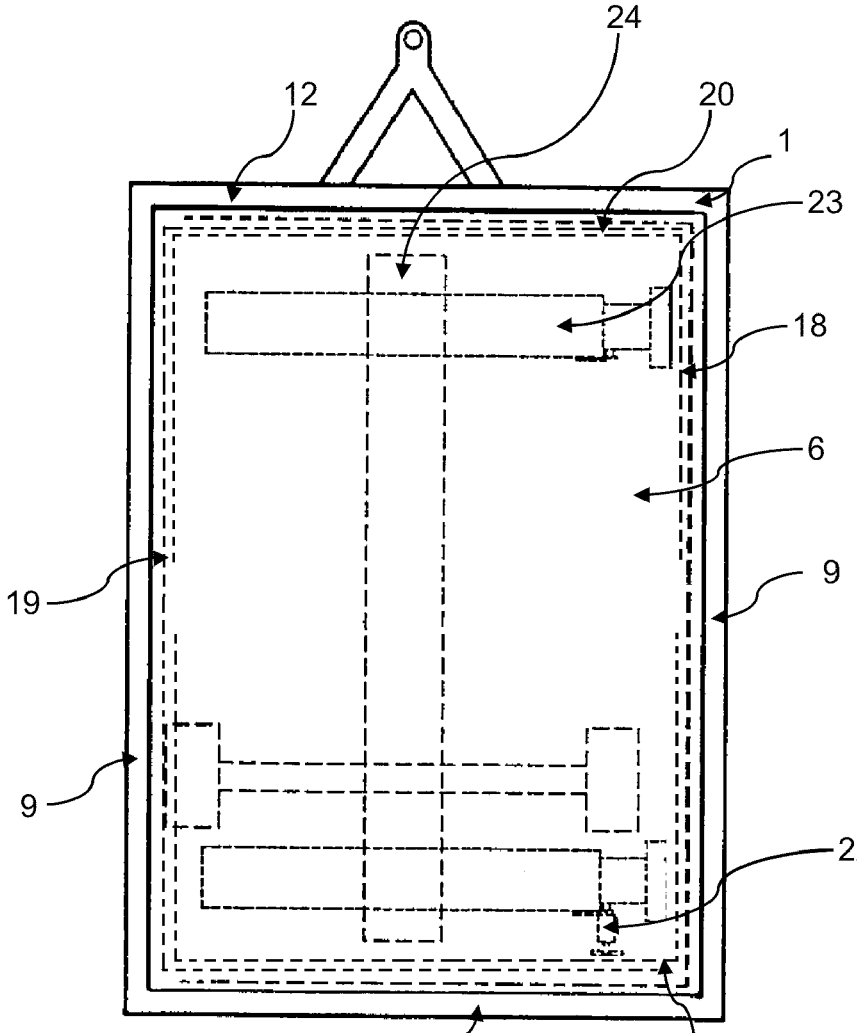
FIG. 13 is an upper view of a first embodiment of a prefabricated structure capable of connecting with other prefabricated structures by means of a plurality of telescopic beds and a fixed bed mounted on a transportation axis.

FIG. 13 is an upper view of the connection proposal for a first invention embodiment. The prefabricated structure 1 comprises two lateral walls 9, a front wall 12, a back wall 13, a fixed main bed 6 and a roof 5, to form a solid hexahedron in which articles are transported. Embedded beneath the fixed main bed 6, a plurality of telescopic beds 18, 19, 20, 21 are found. The prefabricated structure comprises at least one lateral telescopic bed 18, 19, one front bed 20 and one back bed 21. The height distance between each of the beds 6, 18, 19, 20, 21 is preferably minimum, so that once the telescopic beds 18, 19, 20, 21 are extracted from the retracted position, a minimal height difference exists between each bed. However, the telescopic beds may have a ground fixation assembly 22, in this case only shown for the lateral telescopic bed 18, wherein the ground fixation assembly may be retracted and expanded from each of the telescopic beds. The fixation assembly 22 causes a normal bed towards the telescopic bed, so that the telescopic bed supports a determined weight without the rupture of the coupling point 13.

Alternatively, should the height between the beds 6, 18, 19, 20, 21 not be minimum, the ground fixation assembly 22 may include a lift so as to rise the bed and give the telescopic beds 18, 19, 20, 21 a second support so that each of the telescopic beds has the same height as the main fixed bed 6 once extracted or in the case of being at the same height, only a bridge, board or joint creating assembly should be placed allowing the transverse to each prefabricated structure.

Optionally, should the height between the beds 6, 18, 19, 20, 21 not be minimum a joining portion between each of the beds may be incorporated to the system.

Optionally, the prefabricated structure 1 has at least one driven portion 23, such as a piston, which is coupled with the lift, allowing that the telescopic bed be extended from and retracted to the fixed main bed 6. The piston race is limited to the extension that the telescopic bed 18, 19, 20, 21 may have. The driven portions 23 are preferably mounted in the upper part of the prefabricated structure 1 transport axis 2, so that the driven portions have a fixed support. The driven portions 23 are capable of guiding one of the telescopic beds 18, 19, 20, 21 towards the exterior in regards to the main fixed bed 6.

The front bed 20 may be at the same height which is less than the height of the main bed 6, however the height of the front bed 20 is such that it is greater than the back bed 21. The above allows the front bed 20 of a first prefabricated structure 25 to be coupled with the back bed 21 of a second prefabricated structure 17. Likewise, the lateral beds 18, 19 may be in a similar or same height to the height of the front bed 20 so that they may be coupled to the lateral bed 18, 19 of a first prefabricated structure 25 with the main bed 6 of a second prefabricated structure 17.

Figure 17:
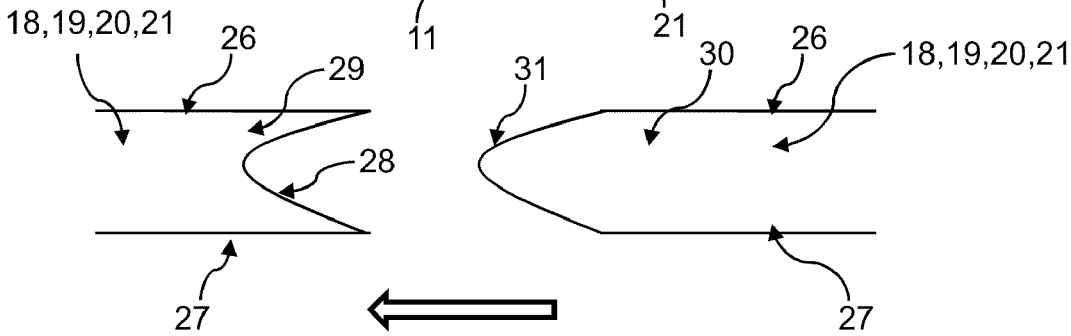
FIG. 17 is a lateral view of the end of a telescopic bed or of the embedded tongues in fixed bed.
Figure 23:
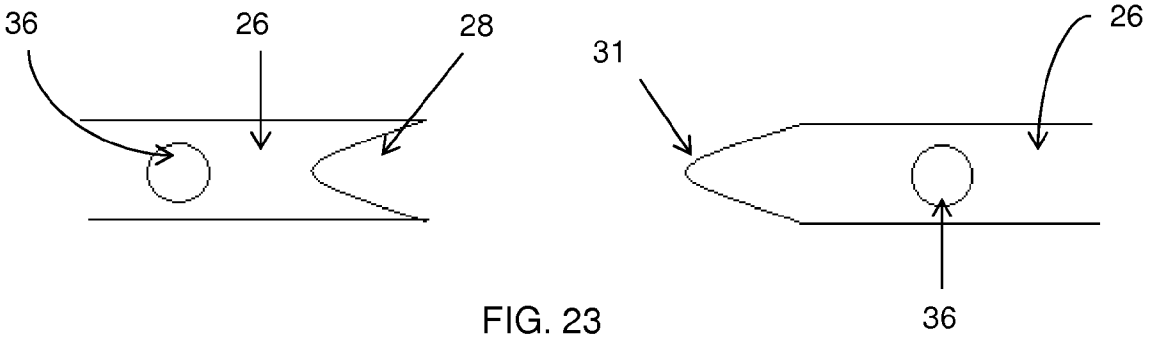
FIG. 23 is a top view of the end of a telescopic bed having a hole for receiving a fastening rod.
Figure 24:
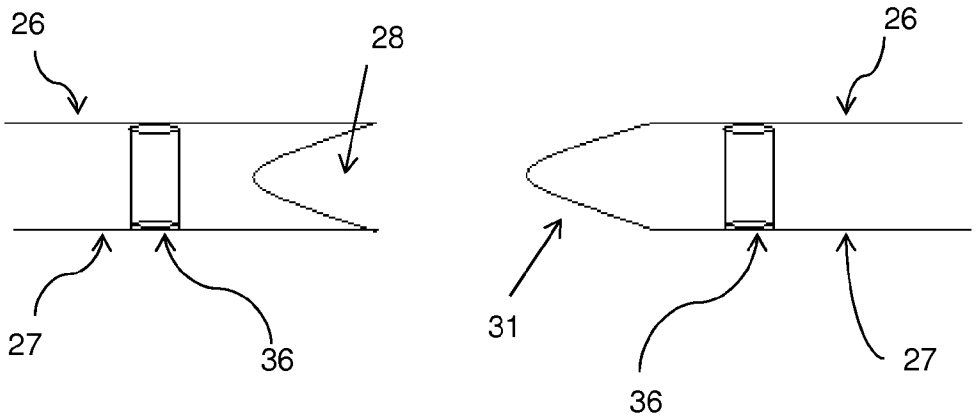
FIG. 24 is a top view of the telescopic bed having a hole from the upper wall to the lower wall.

At least one first telescopic bed end 29 shown in FIG. 17, is preferably formed of two lateral walls, an upper wall 26 and a lower wall 27 which delimit the telescopic bed 18, 19, 20, 21 and a back wall 28. At least a second end of the beds 30 comprise in the same manner an upper wall 26 and a lower wall 27 which delimit the telescopic bed 18, 19, 20, 21 and a front wall 31. In the figure, the back wall 28 and front wall 31 are shown having a concave and convex shape respectively, to couple the beds. However, it is possible that the back wall 28 and the front wall 31 adopt any shape as long as they are coupable between themselves. The back wall 28 and the front wall 31 may have a hole 36 from the upper wall 26 to the lower wall 27 as shown in FIGS. 23 and 24 so that a fastening rod (not shown) crosses said hole and fastens in a fixed manner the telescopic beds 18, 19, 20, 21. These forms of the bed ends are optional.

Figure 14:
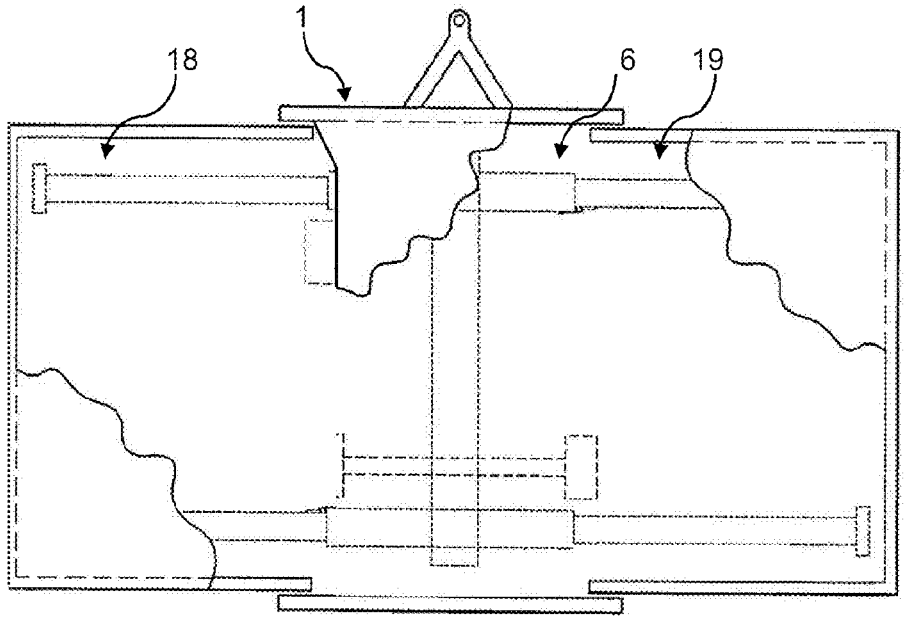
FIG. 14 is an upper view of a first embodiment of a prefabricated structure, wherein the lateral beds of the prefabricated structure have been expanded.

As disclosed before, the prefabricated structures 1 of the invention, may include in a first embodiment a first lateral bed 18 and a second lateral bed 19. FIG. 14 is an upper view of the prefabricated structure 1. As disclosed before, the first lateral bed 18 must be in a height different to the main bed 6. Specifically, the height of the two lateral beds 18, 19 must be less than the height of the main bed 6, however, the height between the two lateral beds 18, 19 is preferably different, so that the longitude of the lateral beds 18, 19 is similar to that of the main bed 6 and so that when said lateral beds are in a retracted or embedded position, said beds 18, 19 fit beneath the main bed 6. The lateral beds 18, 19 are extracted towards the exterior in regards to the main bed 6, wherein the first lateral bed 18 is extractable to a first lateral position in regards to the main bed 6, and a second lateral bed 19 is extractable to a second determined position, opposite to the first position.

Alternatively, the lifts may heighten the lateral beds 18, 19, as well as the back beds 32, 33 to a different height than the main bed 6. This provides a design variation, which gives it a greater aspect to a convention edification structure.

Figure 15:
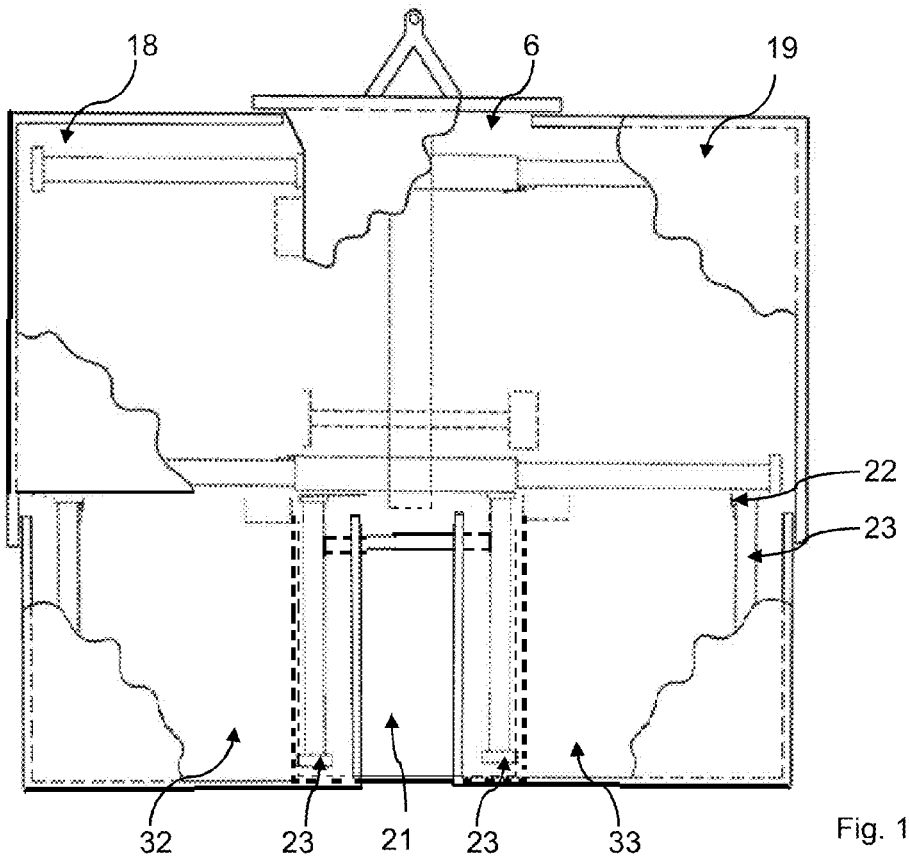
FIG. 15 is an upper view of a first embodiment of a prefabricated structure, wherein the lateral beds and the back bed of the prefabricated structure have been expanded.

In FIG. 15 shows a second proposal of the first embodiment. Specifically, FIG. 15 shows that the main bed 6, as well as both lateral beds 18, 19 have a back bed 21, 32, 33. That is, beneath the main bed, a telescopic back bed 21 is embedded, which is extractable to a third position perpendicular to the first and second position. At the same time, the lateral beds 18, 19 also embed their own back bed, wherein the first lateral bed 18 comprises a back bed 32, and wherein the back bed 32 is telescopic from said lateral bed to the same third position than the telescopic back bed 21 embedded beneath the main bed 6, whilst the second lateral bed 19 comprises a back bed 33, wherein said back bed is telescopic from said second lateral bed 19 to the same position than the telescopic back bed 21 embedded beneath the main bed 6 and the back bed 32 embedded beneath the first lateral bed 18.

The same fixation assembly 22 system and driven system 23 is optionally used in each of the back beds 32, 33. In view of the afore system, a surface or stable solitary and fixed platform of a greater dimension than the main bed 6 may be obtained. This surface or solitary platform will be coupled, as disclosed above, with other surfaces or solitary platforms, to form a platform 10.

Figure 16:
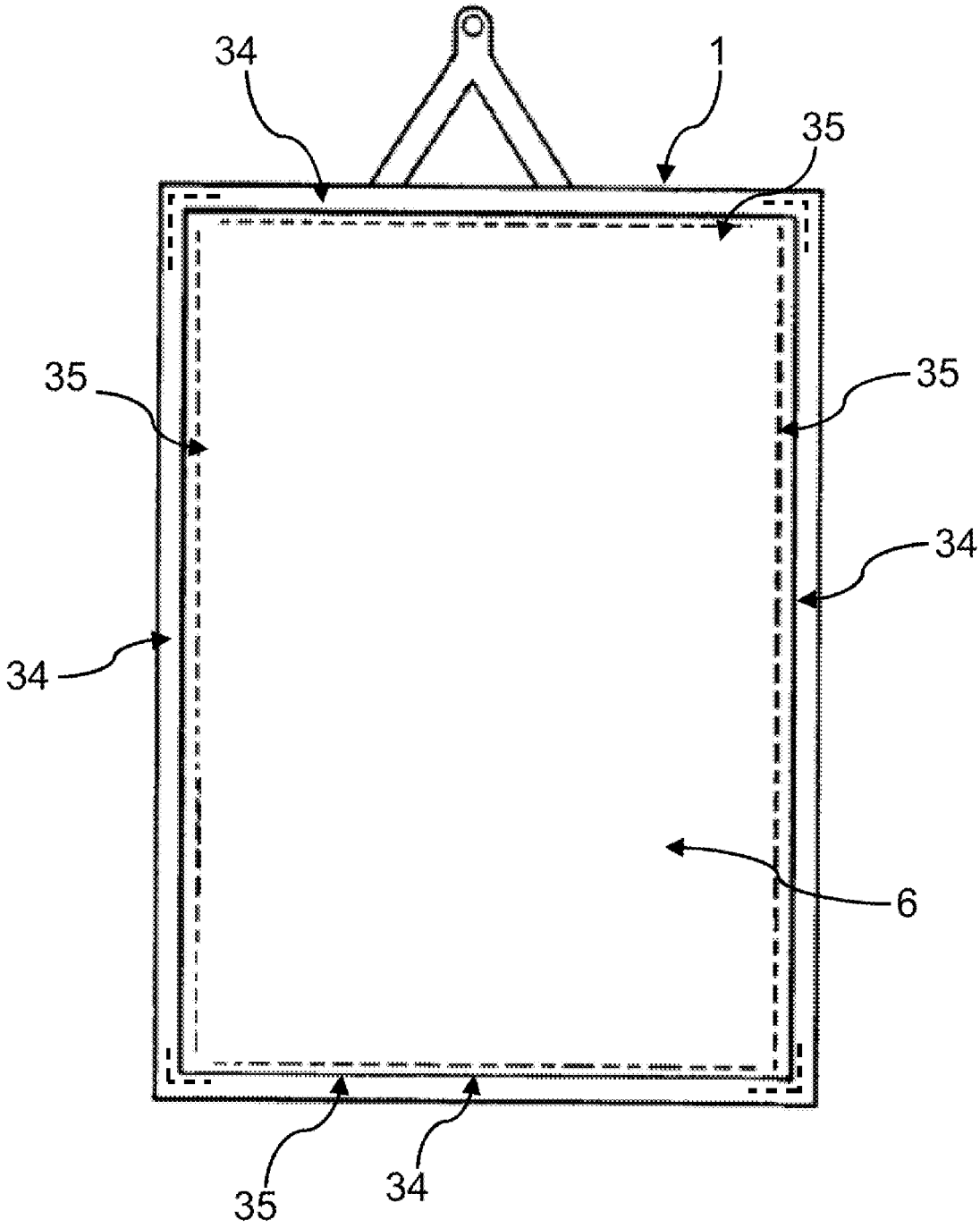
FIG. 16 is an upper view of a second embodiment of a prefabricated structure, capable of connecting with other prefabricated structure by means of a plurality of embedded tongues in a fixed bed.

FIG. 16 shows a second embodiment of the prefabricated structures 1 coupling system. Specifically, the figures shows that the prefabricated structures comprise only a single fixed main bed 6, that is that is not extractable nor telescopic. The fixed main bed 6 has a plurality of tongues 35 which are found in the lateral ends 34 of the main bed 6, or the tongues 35 may be telescopic. That is the edge of the lateral ends 34 of the main bed 6, main have such a configuration, that when naturally coupled with the opposing edge of the other main bed 6, either the tongues may be embedded beneath the main bed 6 or main be telescopic. When the tongues 35 are extracted, these may acquire the same height than the main bed 6 by means of a driven system which creates a normal force over said tongues 35.

The configuration may be the same as shown in FIG. 16, or may be such, that the back wall 28 and the front wall 31 adopt any shape such that they may be coupled between themselves. The back wall 28 and the front wall 31 may have a hole (not shown) from the upper wall 26 to the lower wall 27 so that a fastening rod (not shown) crosses said hole and fastens in a fixed manner the main beds 6 of each prefabricated structure 1 to thus form the platform 10.

The front tongue 35 has a receiving area in its front end, whilst the back tongue 35 has a coupling area which embeds within the front receiving area 35 of a different prefabricated structure. Likewise, the lateral tongue has a receiving area in its front end, whilst the opposite lateral tongue 35 has a coupling area capable of embedding and coupling within the receiving area of the first lateral tongue 35. In this embodiment, lifts and suspensions are not needed, since the prefabricated structure transportation axis 2 will be the suspension and the tongues 35 do not need to be leveled 35 since these are optionally regulating or auto-regulating depending on the placed regulating system.

Likewise, an embodiment may be provided of a fixed main bed 6 of the prefabricated structures, wherein the main fixed bed 6 is not extractable nor telescopic. The main fixed bed 6 does not have tongues either. When parking proximate a prefabricated structure with another, bridges, boards or joint creating assemblies are provided, which when having a greater height than the main fixed bed 6, are capable of joining the coupling points 13 between each of the prefabricated structures.

Figure 18:
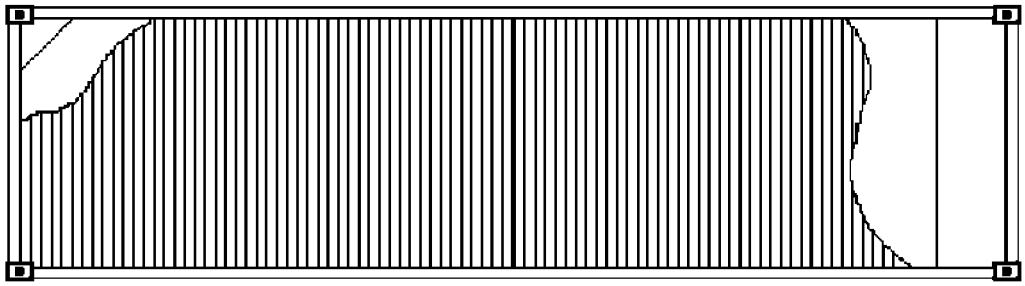
FIG. 18 is a lateral view of the prefabricated structure of the present invention without the transportation axis and the back or front connections.
Figure 19:
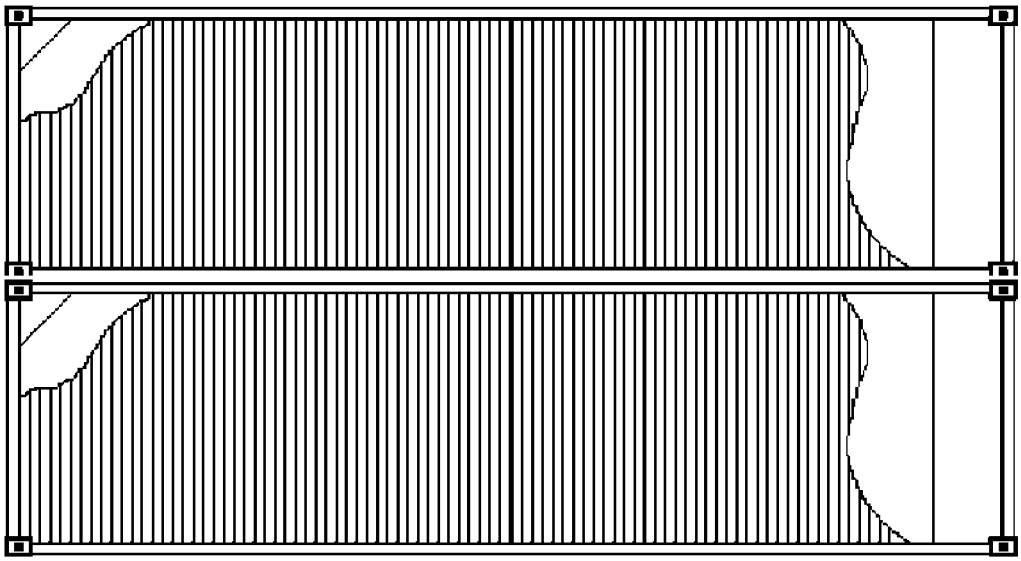
FIG. 19 is a lateral view of the stacking of at least two prefabricated structures without the transportation axis and the back or front connections.

As mentioned before and as seen from FIG. 18 the prefabricated structures allow to be stacked with other similar prefabricated structures, since in their columns, specifically in the borders of said columns, an accessory with holes connected in their outer faces is provided, wherein the accessory is adapted so that cables are tied or fixation pins are placed, called twist locks or any other type of desired fixation. These accessories may be used to hook the containers one with another in a vertical or horizontal manner as seen in FIG. 19, or that the container stays hooked to the transportation axis 2.

Figure 20:
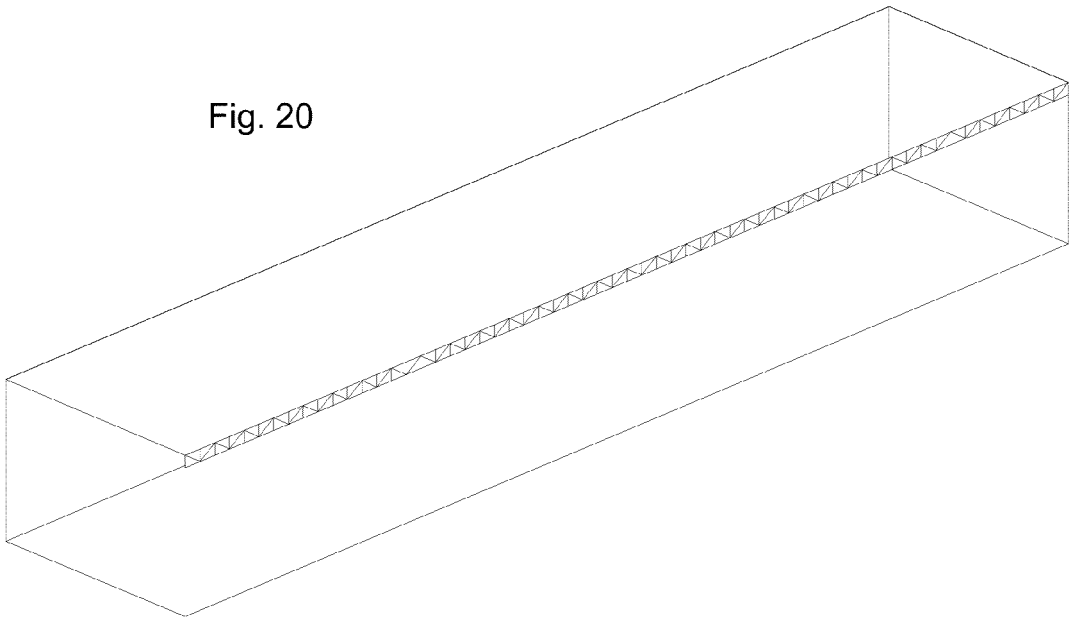
FIG. 20 is a conventional perspective view of the prefabricated structure with a removed lateral wall without the transportation axis and the back or front connections.
Figure 21:
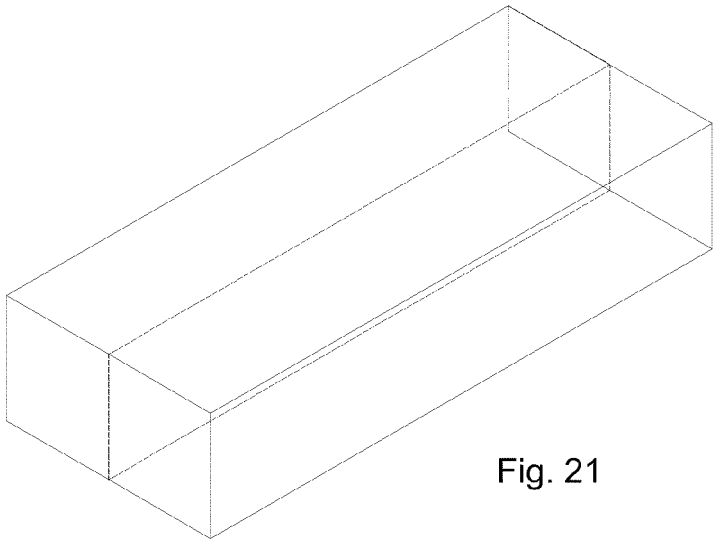
FIG. 21 is a conventional perspective view of two joined prefabricated structures without the transportation axis and the back or front connections.

The lateral walls 9, as well as the front and back walls of the prefabricated structures 1, 3, 4, as well as the front 12 and back 11 walls of the prefabricated structures 1, 3, 4, are capable of being dismounted, dismantled or rolled up to the roof 5 or main bed 6 such as may be seen in FIG. 20 leaving only in each of the lateral ends posts 7, creating a connection between the roof 5 and the main bed 6, so as to sustain the roof 5 of the prefabricated structures 1, 3, 4. Likewise, when dismounting, dismantling, or rolling-up the lateral walls 9 of the prefabricated structures, said prefabricated structures are capable of being joined by any of the afore-mentioned methods, and creating a connection between two or more prefabricated structures.

Figure 22:
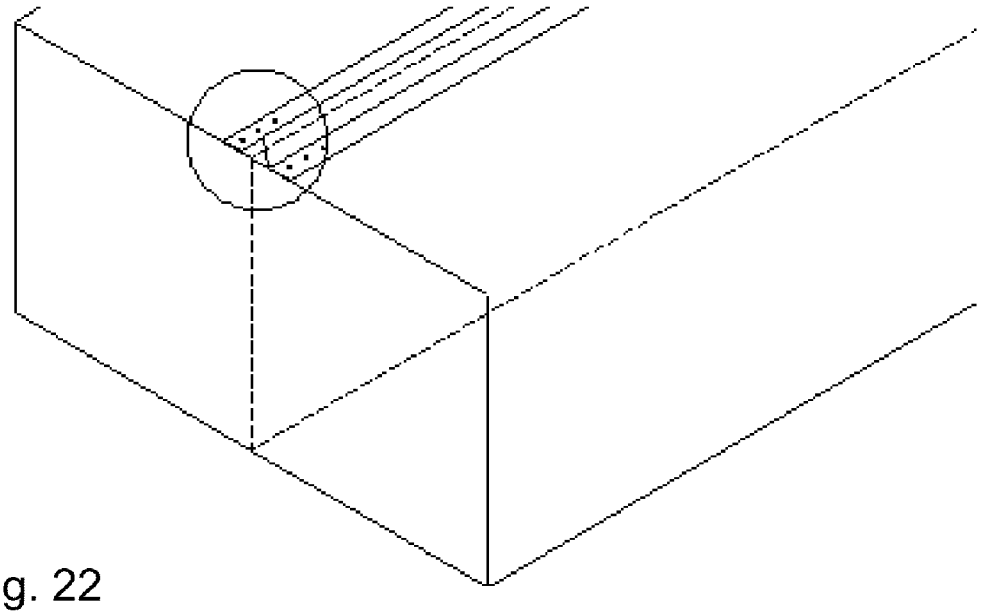
FIG. 22 is a detailed conventional perspective view of one of the multiple joint options for the upper side between two joined prefabricated structures which may likewise serve as the joints of the floor or wall.

Since a lateral wall 9 will not exist in all the units, especially in those intermediates as such, a system should be provided in the coupling point 13 in the roof, so that water, light and other foreign elements to the inner ambient of the platform may not come in. Such is the case of FIG. 22, wherein a channeling member or joint is provided as an example, that covers the coupling point 13 between the prefabricated structures. The form will be disclosed in an exemplifying manner, however, not limitative to said coating between the coupling points 13. Specifically, in this case a channeling member is provided with an inverse "V" form, with smooth sections in the ends of the "V", so as to expel or guide the water.

When the first prefabricated structure reaches the building site, the first prefabricated structure is capable of connecting to the necessary hydroelectric installations. To avoid unnecessary expenses, the second to the "n" number prefabricated structure that is joined to the first prefabricated structure, is capable of connecting by means of the first prefabricated structure to all the hydroelectric and sanitary installations. That is, from the second prefabricated structure, there are no direct connections to the hydroelectric installations, rather indirect connections by means of a first prefabricated structure, so that the second to the "n" number prefabricated structure are dependent on the first prefabricated structure in regards to the hydroelectric installations even when connections to other structures may be included and duplicate this same first prefabricated structure.

For example, if four prefabricated structures are provided in series by their lateral ends forming a platform, a first prefabricated structure is coupled to the hydroelectric installations, such as water, light, drainage and gas among others. The second is dependent upon the first. The third is dependent upon the second and first. The fourth is dependent upon the third, second and first even when an embodiment is that each one is independent.

Since they are prefabricated, the structures are pre-prepared. That is, when leaving the fabrication site each module has prepared and installed all the necessary connections and tubes for the hydroelectric installations, and therefore, the connection and assembly among prefabricated structures is easier. Additionally, this allows the user to disconnect a prefabricated structure from the platform, and towing said structure and reaching another location, and starting a new platform easily and quickly.

That is, in hydroelectric installations, a line tubing with boxes from which branchlines come out for the connection of lamps, switches, contacts or any other type of accessory are installed in the prefabricated unit. Each prefabricated structure has its own installation and each prefabricated structure contains a contact and a plug, so that when joined, said prefabricated structures may be connected, distributing thus the energy to each of the prefabricated structures.

As per the electrical installation, the hydrosanitary installation is also placed in the prefabricated structure. The outputs of each of the prefabricated structures concur in position with the entries of the other prefabricated structure, so that when the building site is reached, the outputs of each prefabricated unit is connected with the entries of the other prefabricated units, providing supplies that will supply the prefabricated structures.

In the fabrication site, the structures are prepared according to what is required. Initially, and in the case of shipping containers and metal made containers, the walls, floors and roofs are sanded, so as to later apply a coating of special steel alkydalic which avoids the corrosion of the steel. Once the sanding and the application of the coating is done, the cuts or curtains are done, so as to respectively dismount, dismantle or roll-up the walls, placing thus doors, windows, accesses, finishes etc. It is possible that, if the whole wall is dismantled, a support structure to sustain the weight of the roof may be needed. The support structure may be done from steel profiles, avoiding thus the roof rupture. Then, the electric and sanitary installations are carried out.

When the electric and sanitary installations have been carried out, the finishes and decorations of the prefabricated structure are carried out, in the inner part as well as the outer part. It is preferable that the steel walls are covered in the inner face and possibly in the outer face with a thermal isolation coating, which may be adhered, melted, nailed, etc., especially in the case of metallic prefabricated structures as are shipping containers, avoiding thus the coming off of the thermal isolating parts from the prefabricated structure steel walls. In the interior of the prefabricated structures, dividing walls may be placed so as to separate one room from another. Further on, should it be required, the placing lower roof or diverse design elements is carried out. To carry out this distribution, profiles are placed throughout the width of each prefabricated structure so as to hook the steel roof with the lower roof and when several prefabricated structures are joined, a decorative joint of the same material or different material is attached to achieve said joint. Likewise, the floor is placed or the same is used that the prefabricated structures already have.

The optional vertical decorative joints are the termination of the pre-decoration process of the prefabricated structures. Optionally, vertical decorative joints are placed above, and more specifically in the outer part of the coupling points. These decorative vertical joints are easily removable so that they may be easily mounted and dismounted. In the inner part of the prefabricated structure, and more specifically in the inner part of the coupling points, decorative vertical joints may also be installed, so as to give a union sense between the walls.

With this, the prefabricated structures have been pre-cut, pre-prepared, pre-isolated and pre-decorated. Once a prefabricated structure is found ready to leave the factory, the prefabricated structure is mounted in a transportation axis and is towed to its building site. The transportation axis is placed and parked proximate to another transportation axis. The transportation axis is capable of being left parked and placed near another transportation axis by a truck. Without dismounting, the prefabricated structures are joined physically and hydroelectrically with another prefabricated structure as was mentioned above. This allows the prefabricated structures to be totally dismountable, i.e. that they may be towed from the building site in a matter of minutes and that they may be installed in a new building site also in a matter of minutes.

Alterations of the disclosed structure in the present, may be seen by those skilled in the art. However, it must be understood that the present description is related to the preferred embodiments of the invention, which is only for illustrative purposes and must not be construed as a limitation of the invention. All the embodiments that do not depart from the spirit of the invention will be included within the following claim breadth.

What is claimed is:

1. A building method with at least two prefabricated containers comprising:

towing a first transportation axis carrying a first prefabricated container to a building site, said first container having at least one lateral wall, a back wall and a front wall;

parking said first transportation axis in said building site;

towing a second transportation axis carrying a second prefabricated container to said building site, said second container having at least one lateral wall, a back wall, a front wall, and lower wall;

parking said second transportation axis proximate to said first transportation axis;

disassembling said at least one lateral, back or front wall of each of said first and second prefabricated containers to define a disassembled side; and joining said first and second prefabricated containers by means of at least one telescopic bed embedded beneath the lower wall of at least one of said first and second prefabricated containers, wherein containers are in communication by said disassembled sides.

2. The building method according to claim 1, wherein the method additionally comprises the steps of mounting said first prefabricated container in said first transportation axis; and mounting said second prefabricated container in said second transportation axis.

3. The building method according to claim 1, wherein said prefabricated containers are pre-cut, pre-prepared, pre-isolated and pre-decorated.

4. The building method according to claim 1, wherein said containers are selected from shipping containers, train containers or semi-trailers.

5. The building method according to claim 1, wherein the method additionally comprises the step of unhooking a load truck from said transportation axis, thus leaving parked the transportation axis.

6. The building method according to claim 1, wherein the method additionally comprises the steps of dismounting a joint formed between said first prefabricated container and said second prefabricated container;

hooking the first or second transportation axis that loads said first or second prefabricated container parked proximate to each other; and towing the first or second prefabricated container to a new building site.

7. The building method according to claim 1, wherein the method additionally comprises the steps of towing a third transportation axis carrying a third prefabricated container to said building site, said third prefabricated container having at least one lateral wall, back wall and front wall;

parking said third transportation axis proximate to said second transportation axis;

disassembling said at least one lateral, back or front wall of said third prefabricated container to define a disassembled side to form a disassembled side; and connecting hydroelectrically said third container by means of said second container; and joining said second and third prefabricated container in such a manner that the prefabricated containers are in communication by means of the disassembled sides.

8. The building method according to claim 1, wherein the method additionally comprises the steps of connecting hydroelectrically the first prefabricated container to hydroelectric connections of said building site; and connecting hydroelectrically the second prefabricated container to hydroelectric connections of said building site by means of said first prefabricated container.

9. The building method according to claim 3, wherein pre-cutting, pre-preparing, pre-isolating and pre-decorating comprises the steps of sanding walls, floors and roofs of the prefabricated containers;

applying a first coating of alkydalic over said walls, floors and roofs;

cutting or making curtains for disassembling said walls;

placing a support structure to sustain the roof weight;

hydroelectrically preparing said first prefabricated container to be connected to hydroelectric installations of said building site;

hydroelectrically preparing said second prefabricated container to be connected to hydroelectric installations of said building site through said first container;

adhering, melting or nailing a thermal isolation coating to the inner and outer face of said walls.

10. The building method according to claim 1, wherein said method additionally comprises the steps of placing vertical decorative joints in an inner part of said walls in a joint point between said prefabricated containers; and placing vertical decorative joints in an outer part of said walls in a joint point between said prefabricated containers.

11. The building method according to claim 1, wherein at least one of said telescopic bed is formed of two lateral walls, an upper wall, lower wall and a back wall, wherein the back wall of a telescopic bed end of a first prefabricated container is coupled to the front wall of a telescopic bed end of a second prefabricated container.

12. The building method according to claim 11, wherein the at least one telescopic bed has a ground fixation assembly which may be retracted and expanded from each of the telescopic beds.

13. The building method according to claim 12, wherein the ground fixation assembly includes a lift so that the at least one telescopic beds has the same height as the lower wall.

14. The building method according to claim 1, wherein the first or second prefabricated container has at least one driven portion mounted in the upper part of the first or second transportation axis, to guide the at least one telescopic bed towards the exterior in regards to the lower wall of the first or second prefabricated container.

15. The building method according to claim 11, wherein the back wall and the front wall comprise a hole from the upper wall to the lower wall so that a fastening rod crosses said hole and fastens in a fixed manner the at least one telescopic bed.

16. The building method according to claim 1, wherein said first and second prefabricated containers may be fixed only by means of the lower beds, wherein said lower walls have a plurality of tongues in their lateral ends.

17. The building method according to claim 16, wherein tongues are embedded beneath the lower wall.

18. The building method according to claim 17, wherein tongues are formed by a receiving area in their front end and a coupling area in their back end so that the coupling area of a first prefabricated structure couples with the receiving area of a second prefabricated structure.

19. A building method with at least two prefabricated containers comprising:

towing a first transportation axis carrying a first prefabricated container to a building site, said first container having at least one lateral wall, a back wall, a front wall and a lower wall;

parking said first transportation axis in said building site;

towing a second transportation axis carrying a second prefabricated container to said building site, said second container having at least one lateral wall, a back wall, a front wall and a lower wall;

parking said second transportation axis proximate to said first transportation axis;

disassembling said at least one lateral, back or front wall of each of said first and second prefabricated containers to define a disassembled side; and joining said disassembled sides of said first and second prefabricated containers by means of a connection system selected from a tongue assembly and a joining system in such a manner that said disassembled sides of said prefabricated containers are in communication, leveling the prefabricated containers by means of at least one lift of at least one of the first and second prefabricated containers;

joining said first and second prefabricated containers by means of a at least one telescopic bed embedded beneath the lower wall of at least one of said first and second prefabricated containers;

wherein containers are in communication by said disassembled sides.

* * * * *